US006174069B1

(12) United States Patent
Plunk et al.

(10) Patent No.: US 6,174,069 B1
(45) Date of Patent: Jan. 16, 2001

(54) "WALL ILLUMINATING LIGHT FIXTURE"

(76) Inventors: Carlton Plunk, 281 N. Third Ave., Saltillo, MS (US) 38866; George Preston, 881 Hunnington Dr., Tupelo, MS (US) 38801; David Dean, 2211 Winding Way, Tucker, GA (US) 30084

( * ) Notice: Under 35 U.S.C. 154(b), the term of this patent shall be extended for 0 days.

(21) Appl. No.: 09/227,125

(22) Filed: Jan. 7, 1999

(51) Int. Cl.[7] ..... F21V 21/02

(52) U.S. Cl. ..... 362/147; 362/223; 362/225

(58) Field of Search ..... 362/147, 223, 362/224, 225, 240

(56) References Cited

U.S. PATENT DOCUMENTS 4,625,267 * 11/1986 Mikalonis ..... 362/150
5,658,067 * 8/1997 Engle et al. ..... 362/222
5,743,627 * 4/1998 Casteel ..... 362/225

* cited by examiner

*Primary Examiner*—Thomas M. Sember
(74) *Attorney, Agent, or Firm*—Hill & Simpson

(57) ABSTRACT

A light fixture includes down lighting for directing light downwardly from the light fixture and includes an auxiliary side light to direct light onto wall surfaces having blackboards, bulletin boards and the like. The side light includes a refraction lens to wash the wall in light. Separate controls for the down light and side light are provided.

9 Claims, 1 Drawing Sheet

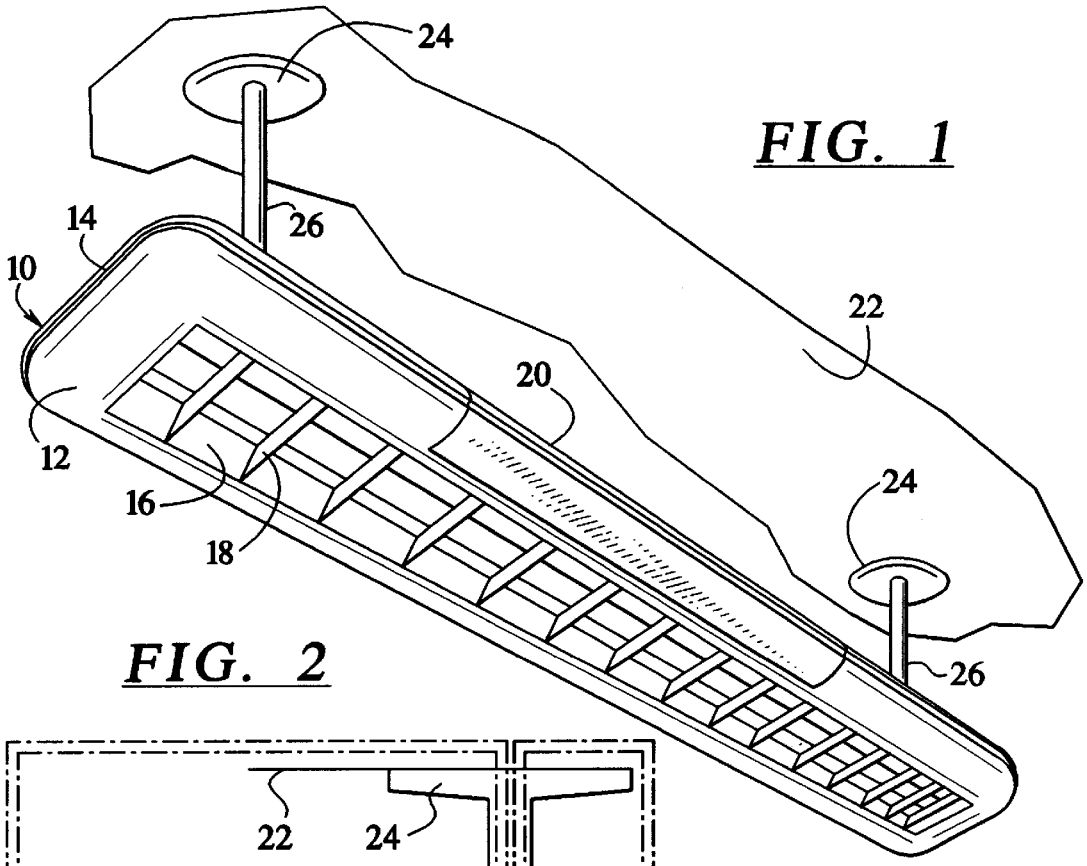
FIG. 1
FIG. 2
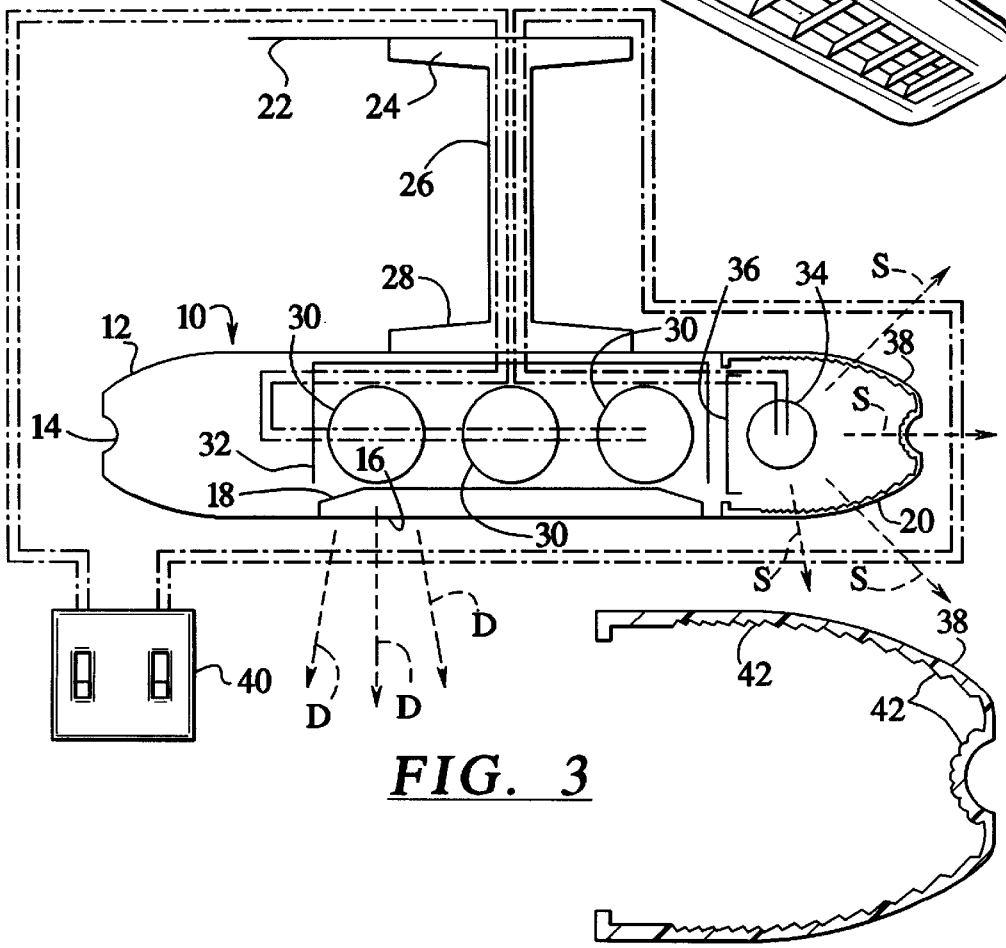
FIG. 3

"WALL ILLUMINATING LIGHT FIXTURE"

BACKGROUND OF THE INVENTION

1. Field of the Invention

The present invention relates generally to a ceiling mounted light fixture for illuminating a wall and/or a room interior.

2. Description of the Related Art

Classrooms, meeting rooms and conference rooms often have blackboards, white boards or bulletin boards mounted on a wall for viewing by students or others in the room. Map, charts, artwork and other displays may also be mounted on a wall for viewing. Lighting for such rooms often is provided as down lighting so that the light is directed into the interior regions of the room, leaving the walls darker than the interior room areas. This results in eye strain and difficulty in seeing the wall mounted displays.

It is common practice to provide a separate light fixture to illuminate the wall mounted displays. Recessed lighting is used for the separate wall directed light fixtures when aesthetics are taken into consideration. Recess directional lighting utilizes incandescent lamps, which use more power than flourescent lamps. The mounting of such additional lights obviously results in additional cost for structurally mounting of the additional lights in or on the ceiling.

SUMMARY OF THE INVENTION

An object of present invention is to provide illumination of a wall display such as for a blackboard, white board, bulletin board, map, diagram without requiring separate and additional light installations.

Another object of the invention is to provide glare-free, low-contrast-ratio lighting of a wall space while being energy efficient.

These and other objects and advantages of the invention are provided by a light fixture having a first portion for providing main illumination in an interior of a room and a second portion providing a separate illumination of a wall space of the room. The present light fixture provides a wash of a vertical surface with a sheet of light by utilization of an auxiliary light in a main light fixture. In one embodiment of the invention, the main light fixture is a suspended light fixture while in another embodiment the main light fixture is a ceiling mounted light fixture.

A reflector and/or refractor lens is provided for the auxiliary light at a side portion of a light fixture for focusing a wash of light on a vertical surface. The light refractor or reflector is, in one embodiment, provided with a separate light source in the side of the main light fixture. It is also possible to utilize light output from the main light fixture to transmit light through the side directed lens and over the vertical surface.

The housing for the light fixture is similar in appearance to fixtures having only the main down lighting and so provides a pleasing aesthetic appearance. The auxiliary light is preferably a fluorescent bulb to provide energy savings.

BRIEF DESCRIPTION OF THE DRAWINGS

FIG. 1 is a perspective view generally from the bottom of a light fixture according to the principles of the present invention;

FIG. 2 is a cross-sectional view of the light fixture of FIG. 1, including a control for the lamps therein; and FIG. 3 is a cross-section of the lens element for the side light portion of the present light fixture.

DETAILED DESCRIPTION OF THE PREFERRED EMBODIMENTS

In FIG. 1 is shown a light fixture 10 for mounting at or near a ceiling surface such as in a room. The light fixture 10 includes a housing 12 which, in one embodiments, is of steel. The housing 12 is shaped as an elongated rectangle having rounded corners and smooth, curved surfaces for a pleasing aesthetic appearance. The housing 10 includes a decorative trim strip 14 about the edge of the housing. At a lower surface of the housing 10 is an opening 16 through which light projects downward from main lamps within the housing. Light directing louvers 18 extend across the opening 16 to direct and distribute the light as well as to provide a pleasing appearance when viewing the light fixture.

Provided at a portion of the side wall of the housing 12 is a side light 20. The side light 20 directs light sidewardly toward a wall or other vertical surface near the light fixture 10. The fixture 10 is mounted from the ceiling near a wall on which is provided the display to be illuminated, with the side light 20 in the direction of the wall. The side light 20 extends along only a portion of the side wall of the rectangular housing 12.

In a preferred embodiment, the housing encloses 48 inch flourescent light bulbs as the main bulbs for down lighting from the housing. One, two, or three such 48 inch light bulbs may be provided. Although light from the main bulbs may be directed through the side light 20, it is preferred that an auxiliary lamp in the form of a compact flourescent lamp be provided as the light source for projecting light from the side light 20.

Referring now to FIG. 2, the present light fixture is shown in cross-section in a mounting suspended from a ceiling surface 22 and a escutcheon plate or decorative plate 24 is provided against the ceiling surface and from which projects a suspension rod 26. Two or more such suspension rods 26 are preferably provided on each section of the light fixture. The suspension rod 26 extends to a support plate 28 at the top surface of the housing 12. The housing 12 is opaque with the exception of the side light portion 20 and the opening 16.

Mounted within the housing 12 are fluorescent lamps 30, three of which are shown in the illustrated embodiment. One, two, or any other number of lamps may be used instead. The lamps 30 are mounted symmetrically within the housing 10. A reflector 32 of polished steel, for example, is mounted within the housing to direct the light from the lamps 30 downwardly through the opening 16. The direction of light from the down light portion of the light fixture is indicated by arrows D.

The side light 20 of the illustrated embodiment includes a compact flourescent bulb 34 mounted asymmetrically within the housing 12. A reflector 36 is provided to direct the light from the lamp 34 in a sideward direction. A lens element 38 of transparent or translucent material surrounds the auxiliary lamp 34. Light from the auxiliary lamp 34 shines in a sideward direction. The lens 38 distributes the light over a wide vertical expanse as indicated by the arrows S so that the display on the wall adjacent the fixture 10 is illuminated by the light from the side light 20. As apparent Light from the main lamps 30 and from the auxiliary lamp 34 are preferably controlled separately from one another by switches 40 linked to the light fixture by wires. The switches 40 may be either wall switches (as shown in FIG. 2), infrared switches, or power line control switches. Thus, for general use, both the main down lamps 30 and the side light 34 are on. For highlighting the wall display, the side light 34 only is on while the main down lights 30 are off. The side light 34 may be turned off when illumination of the wall display is no longer needed.

The shape of the lens 38 about the auxiliary lamp 34 matches the shape of the housing 12, including having an indentation corresponding to the trim strip 14.

An enlarged view of the lens 38 of the side light is shown in FIG. 3. Fresnel elements 42 are formed on the interior of the lens 38 to form a refraction lens to distribute light from the auxiliary lamp 38 onto an adjacent wall, and any blackboard, bulletin board or other display mounted thereon.

Although shown in FIGS. 1 and 2 as a suspended light fixture, it is also contemplated to mount the present fixture directly on the ceiling surface. It is also contemplated that both the main and auxiliary lamps may be controlled by a single controller.

The present invention is ideal for use in classroom settings wherein the light fixture according to the present invention is mounted adjacent walls having blackboards, bulletin boards, maps and other articles to be viewed by students in the classroom. The present invention is also useful in conference rooms and the like. The vertical surface or wall, and any article mounted on the vertical surface such as blackboards or bulletin boards are washed in a sheet of light.

The present light fixture matches other light fixtures not having the side light feature, so that it does not look out of place, the appearance of the present light may be modified to correspond to the appearance of the rest of the lights in the room so as to be unobtrusive. No separate installation is required for effective lighting of the wall display.

Although other modifications and changes may be suggested by those skilled in the art, it is the intention of the inventors to embody within the patent warranted hereon all changes and modifications as reasonably and properly come within the scope of their contribution to the art.

We claim:

1. A light fixture for mounting at a ceiling surface, comprising:

a housing extending below the ceiling surface;

a first lamp mounted in said housing;

means defining a down light opening in said housing in a position to direct light downward from said first lamp;

means defining a side light opening in said housing;

a second lamp mounted in said housing generally at said side light opening; and a lens mounted in said side light opening, said lens directing light from said second lamp sidewardly to a wall and upwardly to the ceiling surface, said lens having a portion overlying said lamp between said lamp and the ceiling surface.

2. A light fixture as claimed in claim 1, wherein said lens has an exterior shape defining a semi-cylindrical indentation extending inwardly toward said second lamp and having a longitudinal extent along said lens parallel to said second lamp.

3. A light fixture as claimed in claim 1, wherein said housing is rectangular and said lens is mounted at only one long side of the rectangular housing.

4. A light fixture as claimed in claim 1, further comprising:

a first reflector mounted in said housing to direct light of said first lamp through said down light opening;

a second reflector mounted in said housing to direct light of said second lamp through said side light opening.

5. A light fixture as claimed in claim 1, further comprising:

a control for controlling said first and second lamps for independent operation.

6. A light fixture as claimed in claim 1, wherein said lens is a refractor lens.

7. A light fixture as claimed in claim 1, further comprising:

suspension members connected to said housing and extending to the ceiling surface so that said housing is suspended below and spaced from said ceiling surface.

8. A light fixture for mounting at a ceiling surface adjacent a wall, comprising:

a down light fixture having a housing; and a side light fixture mounted in only one side of said housing with said down light fixture, said side light fixture having a lamp and a lens, said lens extending about said lamp so as to overlie said lamp between said lamp and said ceiling surface, said lens directing light toward said wall.

9. A method of illuminating a wall, comprising the steps of:

providing a light fixture housing mounted from a ceiling surface adjacent a wall;

providing a down light in said light fixture housing directing light downward from said light fixture, said down light including a down light lamp; and providing a side light in only one side of said light fixture housing with said down light, said side light including a side light lamp separate from said down light lamp, said side light directing light upward and sideward from said light fixture to direct light toward the wall.

* * * * *